United States Patent [19]

Kok et al.

[11] Patent Number: 4,988,600

[45] Date of Patent: Jan. 29, 1991

[54] PARTICULATE ELECTROPHOTOGRAPHIC TONER MATERIAL

[75] Inventors: Piet Kok, Mariakerke-Gent; Luc J. Vanmaele, Lochristi; Serge M. Tavernier, Lint, all of Belgium

[73] Assignee: Agfa-Gevaert, N.V., Mortsel, Belgium

[21] Appl. No.: 492,832

[22] Filed: Mar. 13, 1990

[30] Foreign Application Priority Data

Mar. 24, 1989 [EP] European Pat. Off. ..... 89200766.7

[51] Int. Cl.[5] ..... G03G 9/08

[52] U.S. Cl. ..... 430/110; 430/115; 430/106.6; 430/903

[58] Field of Search ..... 430/110, 115, 903, 106.6

[56] References Cited

U.S. PATENT DOCUMENTS 4,812,379 3/1989 Harnish ..... 430/110

4,927,792 5/1990 Harnish ..... 430/110

*Primary Examiner*—David Welsh

*Attorney, Agent, or Firm*—William J. Daniel

[57] ABSTRACT

Particulate toner material for use in the development of latent electrostatic images, wherein said particulate toner material is capable of acquiring by triboelectric contact electrification a net positive charge and contains thermoplastic resin(s) as binder in combination with a colorant and a colorless compound capable of imparting a positive charge to the particulate toner material in contact electrification, wherein said colorless compound contains at least one piperidine nucleus substituted with an —NH-acyl group, N-substituted ureido or N-substituted thioureido group.

10 Claims, No Drawings

PARTICULATE ELECTROPHOTOGRAPHIC TONER MATERIAL

The present invention relates to particulate toner material for developing electrostatic charge patterns or images.

In electrostatography a latent electrostatic charge image is made visible, i.e. developed, by charged toner particles.

In electrophotography an electrostatic latent charge image is obtained with an electrophotographic material typically comprising a coating of a photoconductive insulating material on a conductive support. Said coating is given a uniform surface charge in the dark and is then exposed to an image pattern of activating electromagnetic radiation such as light or X-rays. The charge on the photoconductive element is dissipated in the irradiated area to form an electrostatic charge pattern which is then developed with an electroscopic marking material. The marking material or toner, as it is also called, whether carried in an insulating liquid or in the form of a dry powder deposits on the exposed surface in accordance with either the charge pattern or the discharge pattern as desired. If the photoconductive element is of the reusable type, e.g. a selenium coated drum, the toner image is transferred to another surface such as paper and then fixed to provide a copy of the original.

A variety of electrostatic developers are available for use in developing electrostatic charge patterns. A distinction is made between dry and liquid developers. In dry developers a distinction is made between single-component and two-component developers which are actually developers wherein carrier particles are mixed with toner particles (ref. Evan S. Baltazzi, Recent Development in Electrophotographic Processes, Materials, and Related Fields-Journal of Applied Photographic Engineering, Vol. 6, No. 6. Dec. 1980, p. 147–152). In two-component developers the carrier particles may comprise various materials and as the name implies, serve as a medium for carrying the electrostatically responsive marking particles to the charge pattern to be developed. Carrier-toner developers can be used in cascade development as described e.g. in U.S. Pat. No. 2,618,552 or in magnetic brush development as described e.g. in U.S. Pat. No. 3,003,462.

The cascade development technique is carried out by rolling or cascading across the electrostatic latent image bearing surface, a developing mixture composed of relatively large carrier particles, each having a number of electrostatically adhering toner particles on its surface. As this mixture rolls across the image-bearing surface, the toner particles are electrostatically deposited on the charged portions of the image.

The magnetic brush development technique involves the use of magnetic means associated with a developing mixture composed of magnetic carrier particles carrying a number of smaller electrostatically adhering toner particles. In this technique the developer composition is maintained during the development cycle in a loose, brushlike orientation by a magnetic field surrounding, for example, a rotatable non-magnetic cylinder having a means with magnetic poles mounted inside. The magnetic carrier particles are attracted to the cylinder by the described magnetic field, and the toner particles are held to the carrier particles by virtue of their opposite electrostatic polarity. Before and during development, the toner acquires an electrostatic charge of a sign opposite to that of the carrier material due to triboelectric charging derived from their mutual frictional interaction. When this brushlike mass of magnetic carrier with adhering toner particles is drawn across the surface bearing the electrostatic image, the toner particles are electrostatically attracted to an oppositely charged latent image and form a visible toner image corresponding to the electrostatic image. Since electrostatic charge remains in the non-exposed areas of a photoconductive surface electrophotography is inherently a direct positive process. In some instances, however, photocopying requires the production of positive prints from photographic negatives.

Such is possible with line negatives as original due to the fringe effect. By the fringe effect negative charges will be induced in the exposed areas which carried originally positive charges but leaked off by the photoexposure. So, if a photoconductor coating being originally overall charged positively has lost its positive charge in correspondence with the line pattern of the original negative, charges of negative sign will be induced in the exposed line pattern by the fringe effect of the still surrounding positive charge pattern. Such makes that positively charged toner will become attracted by said negative charges and a positive image will be developed with respect to the original negative.

Reversal development of large image area will likewise be possible by applying a bias voltage to a magnetic brush applicator which acting as a development electrode induces when positively charged, through the conductive carrier particles a negative charge in the discharged area of the previously positively charged photoconductor coating (ref. R. M. Schaffert "Electrophotography" The Focal Press—London, New York enlarged and revised edition 1975 p. 50–51 and T. P. Maclean "Electronic Imaging" Academic Press-London, 1979 p.231).

In dry toner development systems the toner is normally a fine powder of natural or synthetic resins having a colorant and charge controlling agent dissolved or dispersed therein.

Known positive charge controlling compounds for use in dry toners are dye bases and salts thereof such as nigrosine dye base and salts described in GB-P 1,253,573. Such charge controlling agents are usually added to the thermoplastic resin to be dispersed in the resin in molten state. Upon cooling the mixture is micropulverized and the particles with desired particle size separated e.g. by wind sifter.

Coloured charge controlling substances have the disadvantage that their colour interferes with the colour intensionally given to the toner mass. For the obtaining of neutral black or spectrally pure colours required in multicolour reproduction the inherent colour of the charge controlling substance may form a serious obstacle. Therefore preference is given to the use of colourless charge controlling substances.

According to the published unexamined Japanese patent application (Kokai) 6 0188-959 an electrostatic image developing toner contains as charge controlling agent a piperidine compound corresponding to the following general formula (I):

(I)

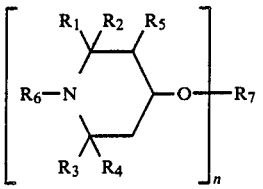

wherein:

$R_1$, $R_2$, $R_3$ and $R_4$ are each 1-6C alkyl, $R_5$ is hydrogen or 1-5C alkyl, $R_6$ is hydrogen or 1-12C alkyl or 3-12C alkenyl, or 7-12C aralkyl; n is an integer of 1-4 and $R_7$ is acyl or N-substituted carbamoyl where n is 1, diacyl, dicarbamoyl or carbonyl where n is 2, triacyl where n is 3 and tetraacyl where n is 4.

It is an object of the present invention to provide a particulate toner material for developing electrostatic charge images which toner material contains a colourless transparent charge controlling agent that does not interfere with the colouring agent of the toner material.

It is a further object of the present invention to provide such toner material wherein the charge controlling agent yields a particularly high positive charge to the toner particles and has a good miscibility or compatibility with the polymeric binder material present in the toner material.

Other objects and advantages of the present invention will become clear from the further description.

In accordance with the present invention there is provided particulate toner material for use in the development of latent electrostatic images, wherein said particulate toner material is capable of acquiring by triboelelectric contact electrification a net positive charge and contains thermoplastic resin(s) as binder in combination with a colorant and a colourless compound capable of imparting a positive charge to the particulate toner material in contact electrification, characterized in that said colourless compound corresponds to the following general formula (A) or is a polymer consisting essentially of repeating units according to general formula (B):

(A)

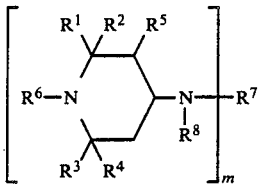

wherein:

each of $R^1$, $R^2$, $R^3$ and $R^4$, independently of each other, stands for a 1-6C alkyl group, $R^5$ represents hydrogen or a 1-5C alkyl group, $R^6$ represents hydrogen, a 1-12C alkyl group, a 3-12C alkenyl group, or a 7-12C aralkyl group, m is 1 to 4, and $R^7$ represents where m is 1 an acyl group, a N-substituted carbamoyl group or a N-substituted thiocarbamoyl group, where m is 2 a carbonyl, thiocarbonyl or a diacyl group, a N-substituted dicarbamoyl group or a N-substituted dithiocarbamoyl group, where m is 3 a triacyl group, a N-substituted tricarbamoyl group or a N-substituted trithiocarbamoyl group, and where m is 4 a tetraacyl group, a N-substituted tetracarbamoyl group or a N-substituted tetrathiocarbamoyl group, the N-substituents of said carbamoyl and thiocarbamoyl groups being a hydrocarbon group or a heterocyclic group, e.g. an alkyl group, an aralkyl group, an aryl group, a polyalkylpiperidinyl group or an alkenyl group, and $R^8$ represents hydrogen, an alkyl group or an aralkyl group, or $R^7$ and $R^8$ together represent the necessary atoms to close a saturated heterocyclic nitrogen containing ring, e.g. piperidinone ring;

(B)

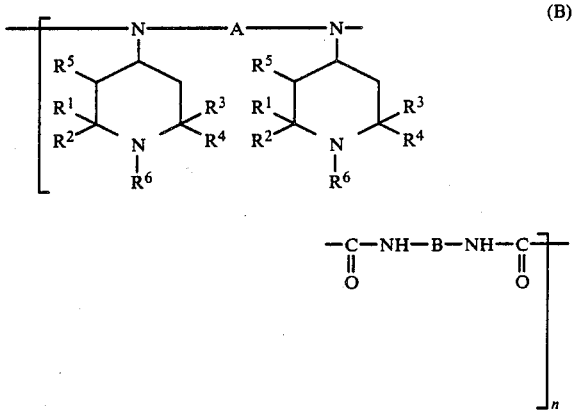

where:

each of $R^1$, $R^2$, $R^3$ and $R^4$, independently of each other, stands for a 1-6C alkyl group, $R^5$ represents hydrogen or a 1-5C alkyl group, $R^6$ represents hydrogen, a 1-12C alkyl group, a 3-12C alkenyl group, or a 7-12C aralkylgroup, each of A and B. independently of each other, represents a 2-12C alkylene group, 7-18 aralkylene group, a 5-12 cycloalkylene group or an arylene group, and n is 2 to 200.

In organic chemical nomenclature "carbamoyl" is also called "carbamyl" and according to the "Naming and Indexing of Chemical Substances for CHEMICAL ABSTRACTS (1985 Index Guide) the name "aminocarbonyl" has been put forward.

In the particulate toner material according to the present invention said colourless compound is used preferably in an amount in the range of 0.5 to 5% by weight with respect to the total toner composition.

Acyl substituted compounds according to the above general formula (A) can be prepared by reacting 4-amino-polyalkylpiperidine with an anhydride or carboxylic acid chloride of a mono-, di-, tri- or tetra-carboxylic acid.

N-carbamoyl and N-thiocarbamoyl substituted compounds according to general formula (A) wherein m = 1 or 2 can be prepared by reacting 4-amino-polyalkylpiperidine with an organic isocyanate and isothiocyanate respectively or by reacting two molecules of 4-amino-polyalkylpiperidine with diphenylcarbonate or phosgene.

The di-, tri- or tetra-carbamoyl and di-, tri- or tetra-thiocarbamoyl substituted compounds according to general formula (A) wherein n = 2 to 4 can be prepared by reacting the necessary number of molecules of a 4-amino-polyalkylpiperidine with an organic di-,tri- or tetra-isocyanate and di-,tri- or tetra-isothiocyanate respectively.

The polymeric polyalkylpiperidine compounds according to general formula (B) can be prepared by polyaddition reaction of a diisocyanate with the diamine that had been obtained already by polycondensation reaction linking two piperidine nuclei with the group A.

Suitable diisocyanate compounds for use in the preparation of compounds according to one of the general formulae (A) or (B) are e.g. 1,6-hexane diisocyanate, 1,4-cyclohexane diisocyanate, 4,4'-diisocyanato-dicyclohexylmethane, 1,4-phenylene diisocyanate, 2,6-tolylene diisocyanate, 4,4'-diisocyanato-diphenylmethane and isophorone diisocyanate.

Examples of compounds for use according to the present invention are mentioned hereinafter together with the description of their preparation.

TABLE 1

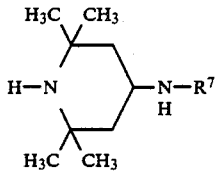

| Compound No. | $R^7$ |
|---|---|
| 1 | CONH-n-$C_{18}H_{37}$ |
| 2 | CONH-phenyl |
| 3 | CONH-cyclohexyl |
| 4 | CSNH-phenyl |
| 5 | CSNH-ethyl |
| 6 | CSNH-cyclohexyl |
| 7 | CSNH-(1,1,3,3-tetramethyl)butyl |
| 11 | CO-n-$C_{15}H_{31}$ |

Preparation of compound No. 1

At room temperature 27 ml (158 mmole) of 2,2,6,6-tetramethyl-4-amino-piperidine was slowly added to a stirred solution of n-octadecyl-isocyanate (55 ml, 158 mmole) in toluene (160 ml). Stirring was continued for 30 minutes. Thereupon the solvent was evaporated and the residue recrystallized from benzine. Yield: 65 g. Melting point: 70° C.

Preparation of compound No. 2

Compound No. 2 was prepared analogously to the preparation of compound No. 1 but by allowing to react 2,2,6,6-tetramethyl-4-amino-piperidine (3.1 g, 20 mmole) with phenylisocyanate (2.4 g, 20 mmole).

Yield: 4.6 g. Melting point: 142° C.

Preparation of compound No. 3

Compound No. 3 was prepared analogously to the preparation of compound No. 1 but by allowing to react 2,2,6,6-tetramethyl-4-amino-piperidine (78 g, 0.5 mole) with cyclohexylisocyanate (65 g, 0.52 mole).

Yield: 73%. Melting point: 150° C.

Preparation of compound No. 4

Compound No. 4 was prepared analogously to the preparation of compound No. 1 but by allowing to react 2,2,6,6-tetramethyl-4-amino-piperidine (3.1 g, 20 mmole) with phenylisothioisocyanate (2.7 g, 20 mmole).

Yield: 2.7 g. Melting point: 182° C.

Preparation of compound No. 5

Compound No. 5 was prepared analogously to the preparation of compound No. 1 but by allowing to react 2,2,6,6-tetramethyl-4-amino-piperidine (78 g, 0.5 mole) with ethylisothioisocyanate (43.5 g, 0.5 mole).

Yield: 58%. Melting point: 140° C.

Preparation of compound No. 6

Compound No. 6 was prepared analogously to the preparation of compound No. 1 but by allowing to react 2,2,6 6-tetramethyl-4-amino-piperidine (78 g, 0.5 mole) with cyclohexylisothioisocyanate (70.5 g, 0.5 mole).

Yield: 54%. Melting point: 135° C.

Preparation of compound No. 7

At 20° C. a solution of carbondisulphide (39.9 g, 0.52 mole) in toluene (25 ml) was added over a period of 12 min to a stirred mixture of 2,4,4-trimethyl-pentyl-2-amine (64.5 g, 0.5 mole), 50 % aqueous NaOH (0.52 mole) and toluene (550 ml). The reaction mixture was stirred for an additional 0.8 h, then warmed to 45° C. and 20 ml of the toluene evaporated under reduced pressure. To the remaining mixture 2,2,6,6-tetramethyl-4-amino-piperidine (81 g, 0.52 mole) and 50% aqueous NaOH (0.1 mole) were added. The mixture was heated at reflux for 1.3 h, cooled down and diluted with water (200 ml). The supernatent organic layer was separated, washed with saturated brine, dried over $MgSO_4$ and concentrated in vacuum. The product was purified by column chromatography. Yield: 18 g. Melting point: 129° C.

Preparation of compound No. 8

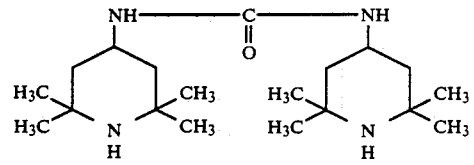

A mixture of diphenylcarbonate (10.7 g , 0.05 mole) and 2,2,6,6-tetramethyl-b 4-amino-piperidine (15.6 g, 0.1 mole) in 100 ml of toluene was boiled with reflux for 2 h. Then the reaction mixture was cooled down to 0° C. The formed precipitate was separated by suction filtering and crystallized from t. butyl, methyl ether. Yield: 10 g. Melting point: 259° C.

Preparation of compound No. 9

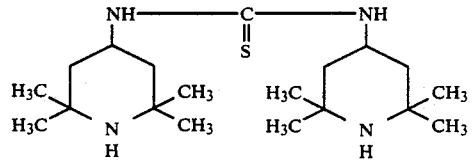

Compound No. 9 was isolated from the reaction mixture obtained in the preparation of compound No. 7. Yield 9.7 g. Melting point: 173° C.

Preparation of compound No. 10

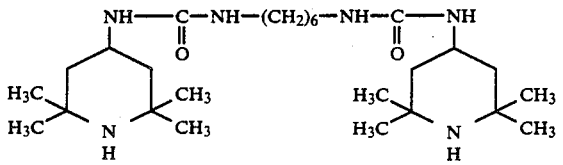

Compound No. 10 was prepared analogously to the preparation of compound No. 1 but by allowing to react 2,2,6,6-tetramethyl-4-amino-piperidine (160 g) with freshly distilled hexamethylene diisocyanate (84 g, 0.5 mole).

Yield: 186 g. Melting point: 188° C.

Preparation of compound No. 11

At a temperature of 0° C. a solution of palmitoyl chloride (27.5 g, 0.1 mole) in 50 ml of methylene chloride was added over a period of 45 minutes to a stirred solution of 2,2,6,6-tetramethyl-4-amino-piperidine (15.6 g, 0.1 mole) in 100 ml of methylene chloride. Stirring is continued for 16 hours, whereafter 75 ml of an aqueous NaOH (4.4 g, 0.11 mole) solution were added and stirring was continued for 1 hour. The organic phase was separated, washed with saturated brine, dried over anhydrous $Na_2SO_4$ and concentrated. The residue recrystallized from benzine. Yield: 14.5 g. Melting point: 65° C.

Preparation of compound No. 12 having following structural formula

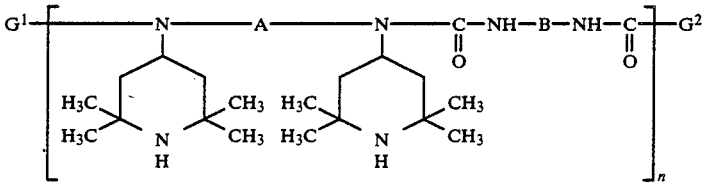

wherein:

$G^1$ is n-$C_{18}H_{37}$-NHCO-, $G^2$ is n-$C_{18}H_{37}$-NH-,

A and B each represent -$(CH_2)_6$-, and n has a value in the range of 2 to 10.

A mixture of hexamethylene diisocyanate (6.7 g, 0.04 mole), 1,6-bis-(2,2,6,6-tetramethyl-4-amino-piperidyl)-hexane (19.7 g, 0.05 mole) and 250 ml of toluene were stirred for 4 hours at room temperature, and thereupon boiled for 1 hour.

Still reactive end-amino groups of the polymer obtained were transformed into ureido groups by adding to the reaction mixture n-octadecyl isocyanate (5.9 g, 0.02 mole) and continuing the boiling for 5 hours. The reaction mass was filtered and the solvent of the filtrate driven off by evaporation. The solid residue left was crystallized from benzine. Yield: 18.5 g. Melting point: 110° C.

The toner material can be prepared by any conventional technique such as spray drying a solution in a suitable volatile solvent or grinding a solidified composition of homogeneously mixed ingredients including a thermoplastic binder, colorant and a colourless positive charge-imparting compound or mixture of compounds according to said general formulae (A) or (B).

The toner particles have preferably a particle size in the range of 1 to 30 μm, and more preferably in the range of 1 to 20 μm.

It has been established experimentally that when the basic ring nitrogen atom of the piperidine nucleus or nuclei of a compound according to of the above general formulae (A) or (B) is transformed into salt form by reaction with an acid or by quaternization the property of acting as a positive charge controlling agent is not lost.

Although the colourless charge controlling substances are preferably present in dissolved state in the thermoplastic resin binder of the toner, such is not strictly necessary. When said substances are present in dispersed state the colour of the colorant is seen less vivid by the opalescent character of the dispersion. A "colloidal" dispersion is obtained mostly when amine-salts and quaternary derivatives of the compounds according to one of the above general formulae (A) or (B) are used.

When amino-salts or quaternary ammonium salts derived from the amines according to one of the above general formulae (A) or (B) are used the anion(s) of these salts may be of any type known in the art. Suitable anions are e.g. hydroxyl ($OH^-$), chloride, iodide, sulfate, $ZnCl^{-4}$, and tolusulfonate. The affinity of the anion with respect to the carrier particle surface may play a role in the triboelectric charging [ref. the book "Electrophotography" by R. M. Schaffert, The Focal Press - London and New York (1975), p. 559-5601.

For lowering the Coulomb attraction of the anions and cations, which may be in favour of the transfer of the anions of the toner particles to the carrier particles whereby triboelectric charging is improved, preferably anions of relatively large size are used, e.g.

$PF_6^-$ and other large size anions such as the tetraphenylboride anion described for use in liquid electrophoretic developers in U.S. Pat. No. 4,525,446.

For obtaining a hard toner which is in favour of a longer developer lifetime because "smearing" of the toner particles on the carrier particles becomes less preference is given to thermoplastic resins having a melting point in the range of 100° to 120° C. and containing in their structure a major part by weight of aromatic groups, e.g. phenyl groups. Said polymers may contain a minor part by weight of electron donating groups, e.g. alkylamino or arylamino groups for still improving the positive triboelectric charging of the toner particles.

The charge imparting compounds yield particularly high positive charging when dissolved or dispersed in a thermoplastic binder being a homopolymer or copolymer of styrene wherein the styrene content is preferably at least 50 mole %. Preferred copolymers of styrene for use in toner material according to present invention are: copolymers of styrene-(meth)acrylic acid esters such as styrene-methyl acrylate copolymer, styrene-ethyl acrylate copolymer, styrene-n-butyl acrylate copolymer, styrene-n-octyl acrylate copolymer, styrene-methyl methacrylate copolymer, styrene-ethyl methacrylate copolymer, styrene-n-butyl methacrylate copolymer, styrene-isobutyl methacrylate copolymer, styrene-n-octyl methacrylate copolymer, styrene-heptadecyl methacrylate copolymer. Further are mentioned copoly(styrene-butadiene) and a copolymer of styrene including up to 25% by weight of monomer units comprising a dialkylamino group.

Preferred copolymers of the last mentioned type have the following structural formula:

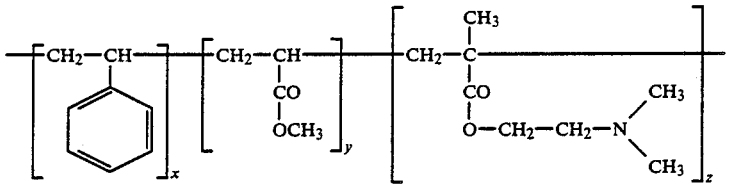

wherein:

x is 83–87% by weight y is 0–4% by weight z is 13–17% by weight, and have a melting point (ring and ball method) in the range of 106° to 115° C. and glass transition temperature (Tg) larger than 60° C.

Said copolymers which may be used separately or in combination can be prepared by common addition polymerisation starting with the monomers involved.

In the particulate toner material according to the present invention the colorant may be a dye or pigment soluble or dispersable in the polymeric binder.

In order to obtain toner particles with sufficient optical density in the spectral absorption region of the colorant, the colorant is used preferably in an amount of at least 2% by weight with respect to the total toner composition, more preferably in an amount of 5 to 15% by weight.

For black toners preference is given to carbon black as a colorant. Examples of carbon black and analogous forms therefor are lamp black, channel black, and furnace black e.g. SPEZIALSCHWARZ IV (trade-name of Degussa Frankfurt/M, W. Germany) and VULCAN XC 72 and CABOT REGAL 400 (trade-names of Cabot Corp. High Street 125, Boston, U.S.A.).

The characteristics of preferred carbon blacks are listed in the following Table 2.

TABLE 2

| | SPEZIALSCHWARZ | CABOT REGAL 400 |
|---|---|---|
| origin | channel black | furnace black |
| density | 1.8 g × $cm^{-3}$ | 1.8 g × $cm^{-3}$ |
| grain size before entering the toner | 25 nm | 25 nm |
| oil number (g of linseed oil adsorbed by 100 g of pigment | 300 | 70 |
| specific surface (sq.m per g) | 120 | 96 |
| volatile material (% by weight) | 12 | 2.5 |
| pH | 3 | 4.5 |

TABLE 2-continued

| | SPEZIALSCHWARZ | CABOT REGAL 400 |
|---|---|---|
| colour | brown-black | black |

Toners for the production of colour images may contain organic dyes or pigments of the group of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York (1950).

Typical inorganic pigments include black iron(III) oxide, copper(II) oxide and chromium(III) oxide powder, milori blue, ultramarine cobalt blue and barium permanganate.

In order to obtain toner particles having magnetic properties a magnetic or magnetizable material be added during the toner production.

Magnetic materials suitable for said use as magnetic or magnetizable metals including iron, cobalt, nickel and various magnetizable oxides including (hematite) $Fe_2O_3$, (magnetite) $Fe_3O_4$, $CrO_2$ and magnetic ferrites, e.g. these derived from zinc, cadmium, barium and manganese. Likewise may be used various magnetic alloy, e.g. permalloys and alloys of cobalt-phosphors, cobalt-nickel and the like or mixtures of any of these. Good results can be obtained with about 30% to about 80% by weight of magnetic material with respect to the resin binder of the toner.

In the preparation of the toner the colorant and optionally magnetic material may be added in finely divided state to the mixture of molten resin binder while stirring until a mixture of homogeneously dispersed or dissolved material in the resin melt is obtained. The mixing temperature is e.g. in the range of 100° to 150° C.

After cooling, the solid mass obtained is crushed and ground e.g. in a hammer mill followed by a jet-mill to an average particle size of 1 to 50 microns. The fraction having a particle size between 1–30 μm separated e.g. by air sifter is used. The resulting powder may not be tacky below 50° C.

For a given charge density of the charge-carrying surface the maximum development density attainable with toner particles of a given size is determined by the charge/toner particle mass ratio, which is determined substantially by the triboelectric charge obtained by friction-contact with the carrier particles.

According to one embodiment the toner according to the present invention is applied as single-component developer whereby its positive charge is obtained by frictional contact with elements of the developing unit.

According to another embodiment the toner according to the present invention is applied in carrier-toner mixture developer wherein the toner acquires a positive charge by frictional contact with the carrier. The carrier-toner mixture is preferably applied to the surface carrying a latent electrostatic image by cascade-, or magnetic brush development which techniques are described in detail by Thomas L. Thourson in his article "Xerographic Development Processes : A Review", IEEE Transactions on Electron Devices. Vol. ED-19, No. 4, April 1972 p. 497–504.

Suitable carrier particles for use in cascade and for magnetic brush development are described in GB-P 1,438,110.

The carrier particles are preferably at least 3 times larger in size than the toner particles and preferably have an average grain size in the range of 50 to 1000 microns, more preferably have an average grain size in the range of 300 to 600 microns when used for cascade development.

The carrier particles may be made of iron or steel optionally provided with an oxide skin. Other types of carriers are on the basis of magnetic material such as ferrites or magnetite finely dispersed in a resin binder material, so-called composite type carriers, examples of which are given in U.S. Pat. No. 4,600,675 and published European patent application 0 289 663. Iron or steel carrier beads may be subjected to special pretreatments to enhance the triboelectric charging of the toner. Suitable coating-treatments of carrier beads are described e.g. in said last mentioned GB-P 1,438,110.

In magnetic brush development the carrier particles are magnetically attractable. Particularly suited are the iron bead carrier particles according to U.S. Pat. No. 2,786,440, which particles have been washed free from grease and other impurities and have a diameter of $1.52\times10^{-1}$ to $2.03\times10^{-1}$ mm.

In a preferred embodiment of the present invention the toner particles are mixed with iron carrier beads of a diameter in the range of 50 to 200 microns having a thin iron oxide skin. These carrier beads have almost a spherical shape and are prepared e.g. by a process as described in GB-P 1,174,571.

The developer composition may for example contain 1 to 5 parts by weight of toner particles per 100 parts by weight of carrier particles.

In order to improve the flowing properties of the developer the toner particles can be mixed with a flow improving substance such as colloidal silica particles and/or microbeads of a fluorinated polymer. The flow improving substance is used e.g. in an amount of 0.05 to 1% by weight with respect to the toner.

Colloidal silica has been described for that purpose in the GB-P 1,438,110. Particularly useful is AEROSIL 300 [trade mark of Degussa, Frankfurt (M) - W.Germany] for colloidal silica having a specific surface area of 300 sq.m/g. The specific surface area can be measured by a method described by Nelsen and Eggertsen in "Determination of Surface Area Adsorption Measurements by Continuous Flow Method", Analytical Chemistry, Vol. 30, No. 8 (1958) 1387–1390.

Suitable fluorinated polymer beads for improving the flowing properties of the toner as well as of the carrier particles are described in the U.S. Pat. No. 4,187,329. A preferred fluorinated polymer for said use is poly(tetrafluoroethylene) having a particle size of 3 to 4 um and melting point of 325°–329° C. Such poly(tetrafluoroethylene) is sold under the trade name HOSTAFLON TF-VP-9202 by Farbwerke Hoechst A.G. W.Germany.

An other fluorinated polymer useful for that purpose is polyvinylidene fluoride having an average particle size of 5 um sold under the trade name KYNAR RESIN 301 by Pennwalt Corp.-Plastic div. England.

The colloidal silica and/or at least one of said fluorinated polymers are preferably mixed with the toner in a proportion of 0.15% to 0.075% by weight. The toner becomes thereby non-tacky and obtains a reduced tendency to form a film on the xerographic plates or drums e.g. having a vapour-deposited coating of a photoconductive Se-As alloy on a conductive substrate e.g. aluminium.

The following examples illustrate the present invention without, however, limiting it thereto. All parts, ratios and percentages are by weight unless otherwise stated.

COMPARATIVE EXAMPLE

Toner preparation without colouring agent

Pseudo toner was prepared without colouring agent to check whether or not the incorporated charge controlling agent yielded a clear mixture on melting with the elected resin binder.

Comparable colourless pseudo toners were prepared by mixing in the melt 5 parts of a furtheron identified charge controlling substance with 95 parts of copolymer of (styrene-n-butylmethacrylate)(65/35) having a ring and ball softening point of 123 ° C. and serving as thermoplastic binder. The mixture was melt-kneaded at 130° C. for 30 minutes. Thereupon the mixture was cooled down to room temperature, crushed and then pulverised by milling in a jet mill.

By wind sifter a toner particle fraction having an average particle size of 13 μm was separated.

Developer preparation

An electroscopic developer was prepared by mixing 3% of the separated toner particles with iron bead carrier particles having an iron oxide skin and average grain size of 80 μm. The triboelectric charging of the resulting powder mixture was realized by a 30 minutes agitation in a metal cylinder having a diameter of 6 cm, being filled for approximately 30% by volume with said mixture and revolving at a speed of 60 rpm.

Measurement

Different triboelectric charge measurement techniques are available all being based on the separation of the toner particles from the admixed carrier particles and the determination of the charge of the separated toner particles directly or indirectly. Depending on the applied technique somewhat differing charge to mass ratio (Q/M) values are obtained expressed in coulomb/gram (C/g). For obtaining comparable results the same separation and measuring technique should be used with toner of the same average particle size since the triboelectric charging is a surface phenomenon.

In the present example the separation of the toner from the carrier particles was realized in a commercially available blow-off type powder charge measuring device. By calculating the surface area of the pseudo toner for a given mass and using the Q/M data from the resulting blow-off separation the charge density was calculated, and expressed in $C/cm^2$.

In Table 3 the results obtained with charge controlling compounds Nos. 1 to 12 mentioned hereinbefore and charge controlling compound No. 14 of the published unexamined Japanese patent application (Kokai) 6 0188-959 having the following structure are given.

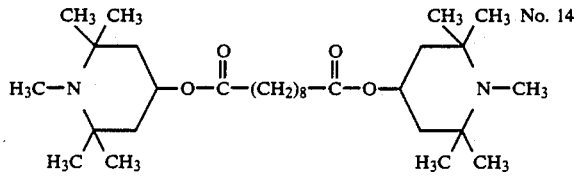

No. 14

TABLE 3

| Charge controlling agent | $10^{-10}$ C/cm$^2$ |
|---|---|
| No. 14 (prior art) | +8.1 |
| No. 1 | +25.3 |
| No. 2 | +15.7 |
| No. 3 | +13.2 |
| No. 4 | +11.1 |
| No. 5 | +14.4 |
| No. 6 | +20.5 |
| No. 7 | +20.6 |
| No. 8 | +14.5 |
| No. 9 | +16.5 |
| No. 10 | +15.0 |
| No. 11 | +22.6 |
| No. 12 | +31.1 |

The above pseudo toner materials are colourless and are perfectly suited for introducing therein any colorant without interference in colour with the charge controlling agents.

We claim:

1. Particulate toner material for use in the development of latent electrostatic images, wherein said particulate toner material is capable of acquiring by triboelectric contact electrification a net positive charge and contains thermoplastic resin(s) as binder in combination with a colorant and a colourless compound capable of imparting a positive charge to the particulate toner material in contact electrification, characterized in that said colourless compound corresponds to the following general Formula (A) or is a polymer consisting essentially of repeating units according to general formula (B) or is an amine-salt or quaternary ammonium derivative thereof:

(A)

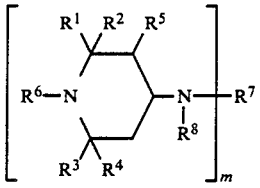

wherein:

each of $R^1$, $R^2$, $R^3$ and $R^4$ independently of each other, stands for a 1-6C alkyl group, $R^5$ represents hydrogen or a 1-5C alkyl group, $R^6$ represents hydrogen, a 1-12C alkyl group, a 3-12 C alkenyl group, or a 7-12C aralkyl group, m is 1 to 4, and $R^7$ represents where m is 1 an acyl group, a N-substituted carbamoyl group or a N-substituted thiocarbamoyl group, where m is 2 a carbonyl thiocarbonyl or a diacyl group, a N-substituted dicarbamoyl group or a N-substituted dithiocarbamoyl group, where m is 3 a triacyl group, a N-substituted tricarbamoyl group or a N-substituted trithiocarbamoyl group, and where m is 4 a tetraacyl group, a N-substituted tetracarbamoyl group or a N-substituted tetrathiocarbamoyl group, the N-substituents of said carbamoyl and thiocarbamoyl groups being a hydrocarbon group or a heterocyclic group, and $R^8$ represents hydrogen an alkyl group or an aralkyl group, or $R^7$ and Rhu 8 together represent the necessary atoms to close a saturated heterocyclic nitrogen containing ring;

(B)

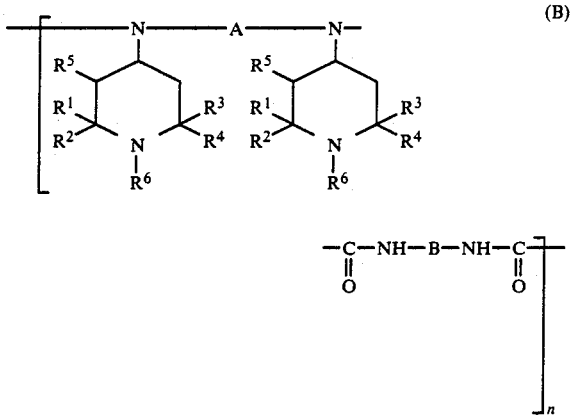

wherein:

each of $R^1$, $R^2$, $R^3$ and $R^4$, independently of each other, stands for a 1-6C alkyl group, $R^5$ represents hydrogen or a 1-5C alkyl group, $R^6$ represents hydrogen, a 1-12 C alkyl group, a 3-12C alkenyl group, or a 7-12C aralkyl group, each of A and B, independently of each other, represents a 2-12C alkylene group, 7-18 aralkylene group, a 5-12 cycloalkylene group or an arylene group, and n is 2 to 200.

2. Particulate toner material according to claim 1, wherein said colourless compound is used in amount in the range of 0.5 to 5% by weight with respect to the total toner composition.

3. Particulate toner material according to claim 1, wherein said colourless compound is dissolved or dispersed in a thermoplastic hinder being a homopolymer or copolymer of styrene wherein the styrene content is at least 50 mole %.

4. Particulate toner material according to claim 3, wherein said copolymer is selected from the group consisting of styrene-methyl acrylate copolymer, styrene-ethyl acrylate copolymer, styrene-n-butyl acrylate copolymer, styrene-n-octyl acrylate copolymer, styrene-methyl methacrylate copolymer, styrene-ethyl methacrylate copolymer, styrene-n-butyl methacrylate copolymer, styrene-isobutyl methacrylate copolymer, styrene-n-octyl methacrylate copolymer styrene-heptadecyl methacrylate copolymer, copoly(styrene-butadiene), and a copolymer of styrene including up to 25% by weight of monomer units comprising a dialkylamino group.

5. Particulate toner material according to claim 1, wherein the colorant is carbon black.

6. Particulate toner material according to claim 1, wherein the colorant is an organic pigment or dye selected from the group consisting of phthalocyanine dyes, quinacridone dyes, triaryl methane dyes, sulphur dyes, acridine dyes, azo dyes and fluoresceine dyes.

7. Particulate toner material according to claim 1, wherein the toner particles incorporate a magnetic or magnetizable material.

8. Particulate toner material according to claim 1, wherein said material is present in admixture with carrier particles suited for use in cascade-, or magnetic brush development of latent electrostatic charge images.

9. Particulate toner material according to claim 8, wherein said carrier particles are at least 3 times larger in size than the toner particles and have an average grain size in the range of 50 to 1000 microns.

10. Particulate toner material according to claim 8, wherein the carrier particles are made of iron or steel provided with an oxide skin.

* * * * *